US007070152B2

(12) United States Patent
Schwiede et al.

(10) Patent No.: US 7,070,152 B2
(45) Date of Patent: Jul. 4, 2006

(54) SLEEPER-MOUNTED RAILROAD-SWITCH ACTUATOR

(75) Inventors: Karl-Heinz Schwiede, Kreuzlingen (CH); Frank Meyer, Stockach (DE)

(73) Assignee: Schwihag Gesellschaft fur Eisenbahnoberbau mbH, Tagerwilen (CH)

( * ) Notice: Subject to any disclaimer, the term of this patent is extended or adjusted under 35 U.S.C. 154(b) by 0 days.

(21) Appl. No.: 10/844,814

(22) Filed: May 12, 2004

(65) Prior Publication Data

US 2004/0227037 A1 Nov. 18, 2004

(30) Foreign Application Priority Data

May 13, 2003 (DE) ..... 103 21 604

(51) Int. Cl.
*B61L 9/04* (2006.01)

(52) U.S. Cl. ..... 246/476; 246/415 R; 246/221; 246/393

(58) Field of Classification Search ..... 246/415 R, 246/258, 382, 448, 157, 393, 396, 221, 452, 246/257, 158, 476; 238/32, 33
See application file for complete search history.

(56) References Cited

U.S. PATENT DOCUMENTS

| | | | | | |
|---|---|---|---|---|---|
| 1,572,089 | A | * | 2/1926 | Schryock | 246/448 |
| 1,770,421 | A | * | 7/1930 | Nell | 246/401 |
| 1,802,875 | A | * | 4/1931 | Conley | 246/415 R |
| 2,315,243 | A | * | 3/1943 | Bussler | 246/448 |
| 4,093,163 | A | * | 6/1978 | Larsson | 246/476 |
| 5,292,091 | A | * | 3/1994 | Callegari et al. | 246/258 |
| 5,562,267 | A | | 10/1996 | Heim | |
| 5,620,156 | A | * | 4/1997 | Berggren et al. | 246/221 |
| 6,158,698 | A | * | 12/2000 | Click et al. | 246/449 |

* cited by examiner

*Primary Examiner*—Frantz F. Jules
(74) *Attorney, Agent, or Firm*—Andrew Wilford

(57) ABSTRACT

A railroad switch actuator has a transversely extending box sleeper having a pair of ends, adapted to be secured to a pair of longitudinally extending fixed rolling rails, and adapted to slidably support a pair of longitudinally extending and transversely shiftable switch tongues. A switch rod extends transversely in the box sleeper, is connected to the tongues, is centered on a transverse axis, and is displaceable along the transverse axis to shift the tongues. A drive having an output shaft is supported on one end of the sleeper by a hinge for pivotal movement between a down position outboard of the one sleeper end and with the output shaft axially aligned with the switch rod and an up position between the sleeper ends.

11 Claims, 7 Drawing Sheets

SLEEPER-MOUNTED RAILROAD-SWITCH ACTUATOR

FIELD OF THE INVENTION

The present invention relates to an actuator for a railroad switch. More particularly this invention concerns such an actuator that is mounted on a sleeper.

BACKGROUND OF THE INVENTION

As described in U.S. Pat. No. 5,562,267 of Heim, it is known to mount the actuator for a railroad switch on a so-called box sleeper of generally standard dimensions. Such a box sleeper is formed as an upwardly open channel to which the fixed rails are bolted and on which the switch tongues can slide. A switch rod in the sleeper, which typically is upwardly closed by a cover plate when installed, extends out a drive end of the sleeper to a motor unit that is carried at the drive end.

Thus this sleeper with the drive constitutes a fairly long piece of equipment cannot be transported to the installation site mounted crosswise on a rail car, like a standard sleeper, because its length substantially exceeds the normal sleeper length and is thus to wide for most rights of way. Thus the drive sleeper must be shipped separate from the other sleepers and must be oriented lengthwise of the flat car it is shipped on, making its handling difficult and generally bothersome. Alternately the drive unit can be mounted in the field onto the end of the box sleeper, a job that is fairly complex and often difficult to carry out in view of the often difficult site conditions.

OBJECTS OF THE INVENTION

It is therefore an object of the present invention to provide an improved sleeper-mounted railroad-switch actuator.

Another object is the provision of such an improved sleeper-mounted railroad-switch actuator which overcomes the above-given disadvantages, that is which can be shipped normally along with the standard sleepers not equipped with switch actuators.

SUMMARY OF THE INVENTION

A railroad switch actuator has according to the invention a transversely extending box sleeper having a pair of ends, adapted to be secured to a pair of longitudinally extending fixed rolling rails, and adapted to slidably support a pair of longitudinally extending and transversely shiftable switch tongues. A switch rod extends transversely in the box sleeper, is connected to the tongues, is centered on a transverse axis, and is displaceable along the transverse axis to shift the tongues. A drive having an output shaft is supported on one end of the sleeper by a hinge for pivotal movement between a down position outboard of the one sleeper end and with the output shaft axially aligned with the switch rod and an up position between the sleeper ends. A coupling is engageable between the output shaft and the switch rod in the down position.

With this system, therefore, the entire sleeper-mounted actuator can be assembled in the plant. Its drive can be carefully aligned with the switch rod and so on. Then the drive is flipped up into the up position and the assembly, which is now the same length as a regulation sleeper, can be shipped to the installation site along with the other sleepers. At the installation site it is set in position by the same equipment that sets and tamps standard sleepers, then the drive is pivoted down and, according to the invention, secured in place. The output shaft of the drive is coupled to the switch rod, and the installation is complete. The extra production cost entailed in replacing the otherwise necessary one-piece mount or mounts for the drive with hinges is more than outweighed by the saving at the installation site, where the drive is easily secured in position and coupled up, with nothing more complicated than cotter pins being used. The precise alignment of the drive shaft with the switch rod has been done at the factory, so that no skilled mechanics are needed in the field.

The hinge according to the invention defines a pivot axis that lies substantially above the switch-rod axis at the one sleeper end. Thus even without a latch holding the drive down, gravity will serve to keep it in place and, when the motor in the drive is moving the switch rod, the forces will not be sufficient to lever up the heavy drive.

The hinge in accordance with the invention includes two eyes centered on the pivot axis and fixed to an upper side of the box sleeper and respective rigid arms on the drive having inner ends formed as eyes pivoted on the eyes of the sleeper. The arms can be generally Z-shaped and have outer ends extending underneath the drive and webs that lie flatly against the one sleeper end in the down position of the drive. Respective reinforcement webs are provided on the arms at inside corners between the respective inner arms and webs. The arms can have outer-ends tips that project in the down position horizontally outward past the drive and that can be used to bolt down the drive in the down installed position. In this case a sacrificial strut extending generally vertically between one of the outer-end tips and the box sleeper in the up position supports the drive on the box sleeper, bracing it against damage during transport. Once the drive is pivoted down when the actuator is installed, the strut is discarded. In addition this construction means that the drive motor can be covered at the factory with a rugged housing that need not be removed in the field for the final installation.

In another embodiment of the invention respective L-shaped plates each have an inner leg forming a respective one of the eyes and lying on an upper surface of the box sleeper and an outer leg lying flatly against an end face of the one sleeper end. A web can unitarily join the outer legs of the plates below the rod axis. This makes a very strong connection between the drive and the sleeper.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
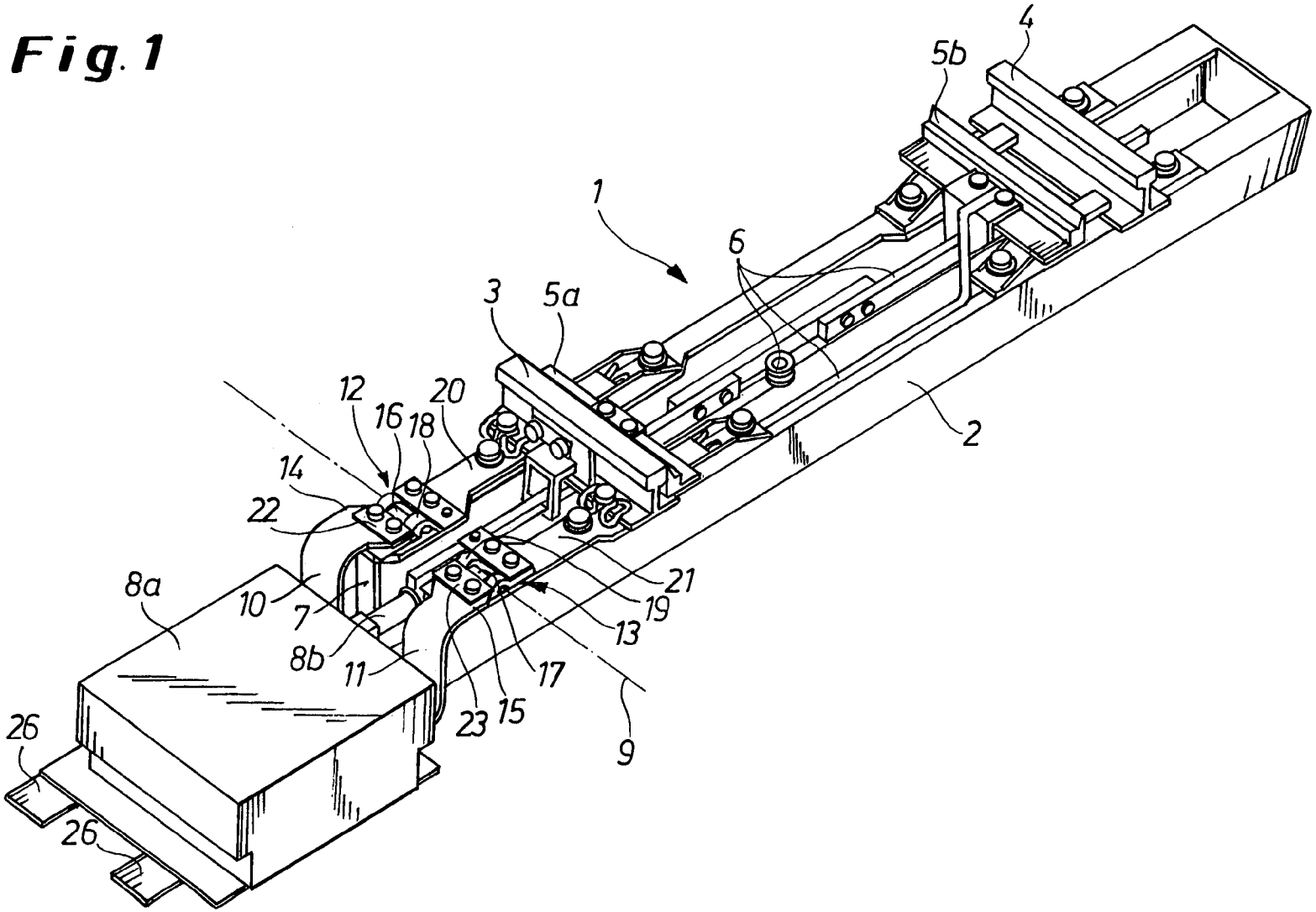
FIG. 1 is a perspective view from above of the instant invention in the installed position.

As seen in FIGS. 1 to 5, an actuator 1 according to the invention is mounted on a box sleeper 2 formed as an upwardly open channel that extends transversely of a pair of standard rails 3 and 4 that are fixedly bolted to it and that extend longitudinally. A pair of switching tongues 5*a* and 5*b* are slidable transversely atop the box sleeper 2 as is standard in a railroad switch. These tongues 5*a* and 5*b* are secured together by a switch rod 6 that extends along a horizontal axis 36 underneath the upper surface of the sleeper 2 and perpendicular to the rails 3 and 4 so that transverse shifting, that is parallel to the axis 36, of the rod 6 operates the switch.

According to the invention a drive unit 8*a* is mounted at a drive end 7 of the sleeper 2 for pivoting about a horizontal and longitudinal axis 9 that is above and perpendicular to the axis 36 of the switch rod 6. To this end the drive 8*a* is fixed to a pair of longitudinally spaced Z-shaped mounting arms or bars 10 and 11 having outer ends 26 to which the drive 8*a* is fixed and which even extend outward somewhat past this drive 8*a* and inner ends 14 and 15 connected by hinges 12 and 13 to the sleeper 2. These hinges 12 and 13 are formed by respective eyes 16 and 17 on the bars 10 and 11 that lie between pairs of eyes 18 and 19 that are part of plates 20 and 21 that are bolted to the top surfaces of the upright flanges of the box sleeper 2. Pins 33 interconnect the eyes 16 and 18, and pins 34 interconnect the eyes 17 and 19 at the axis 9.

Figure 3:
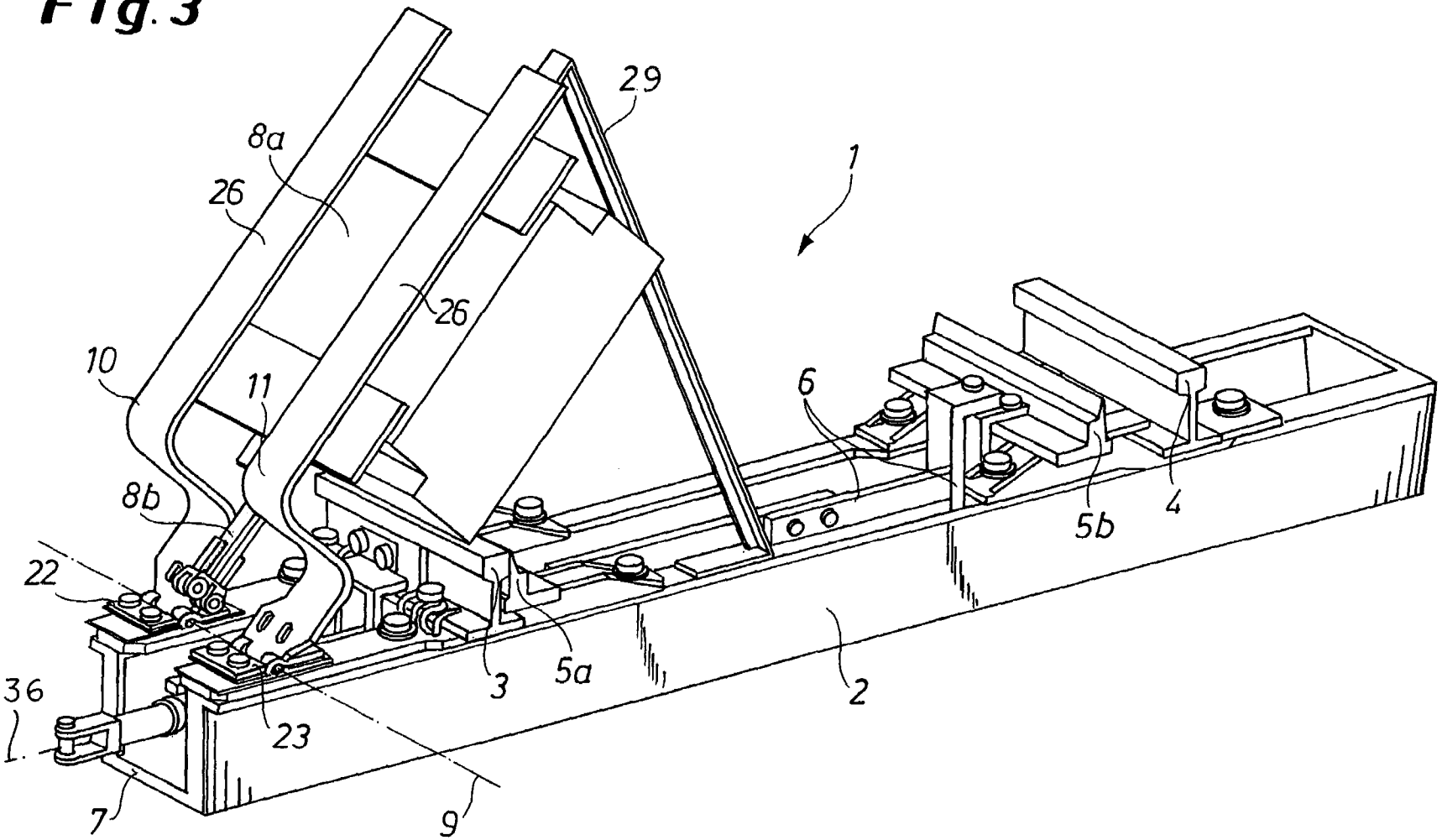
FIG. 3 is a perspective view like FIG. 1, but with the sleeper-mounted actuator in the shipping position.
Figure 4:
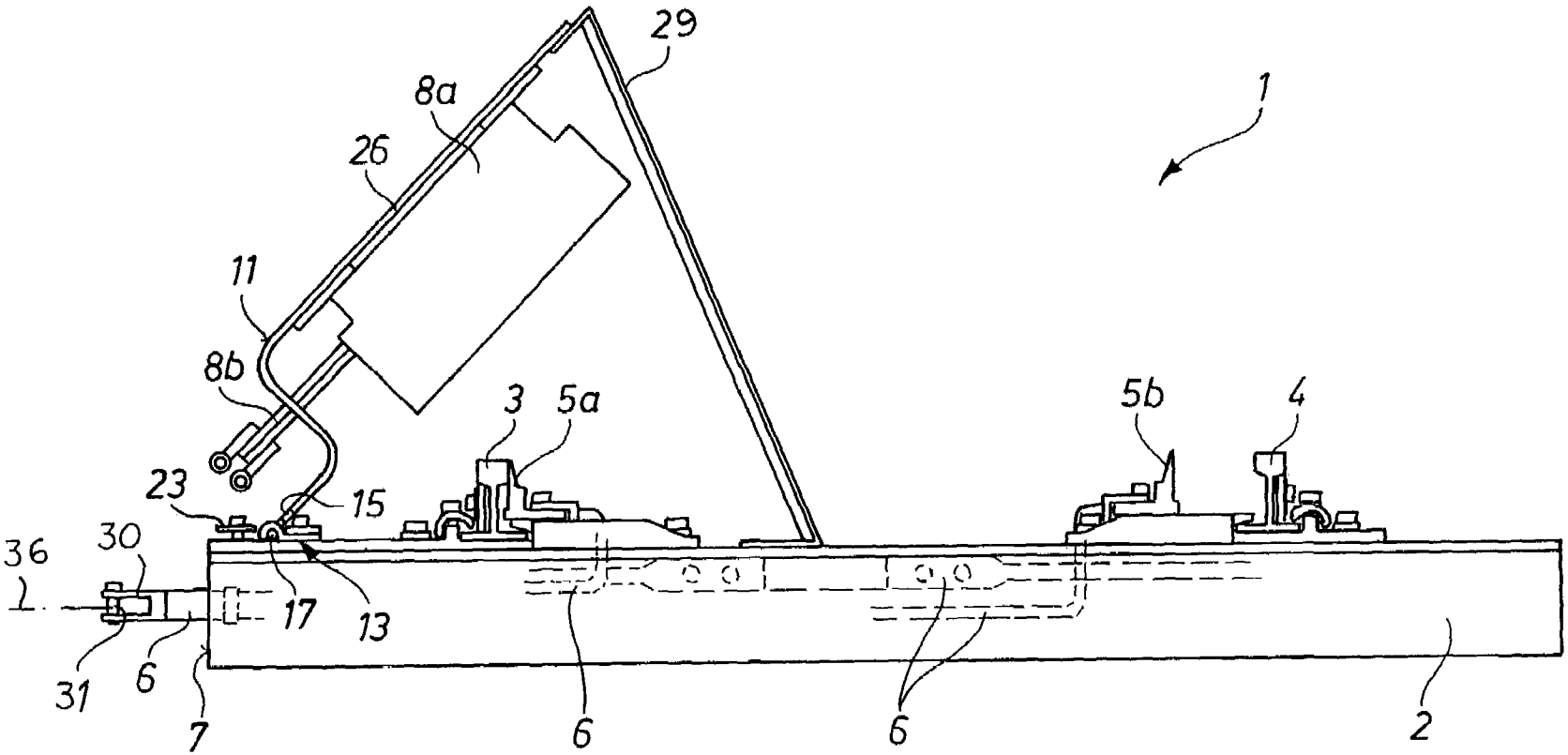
FIG. 4 is a side view of the actuator in the FIG. 3 shipping position.
Figure 5:
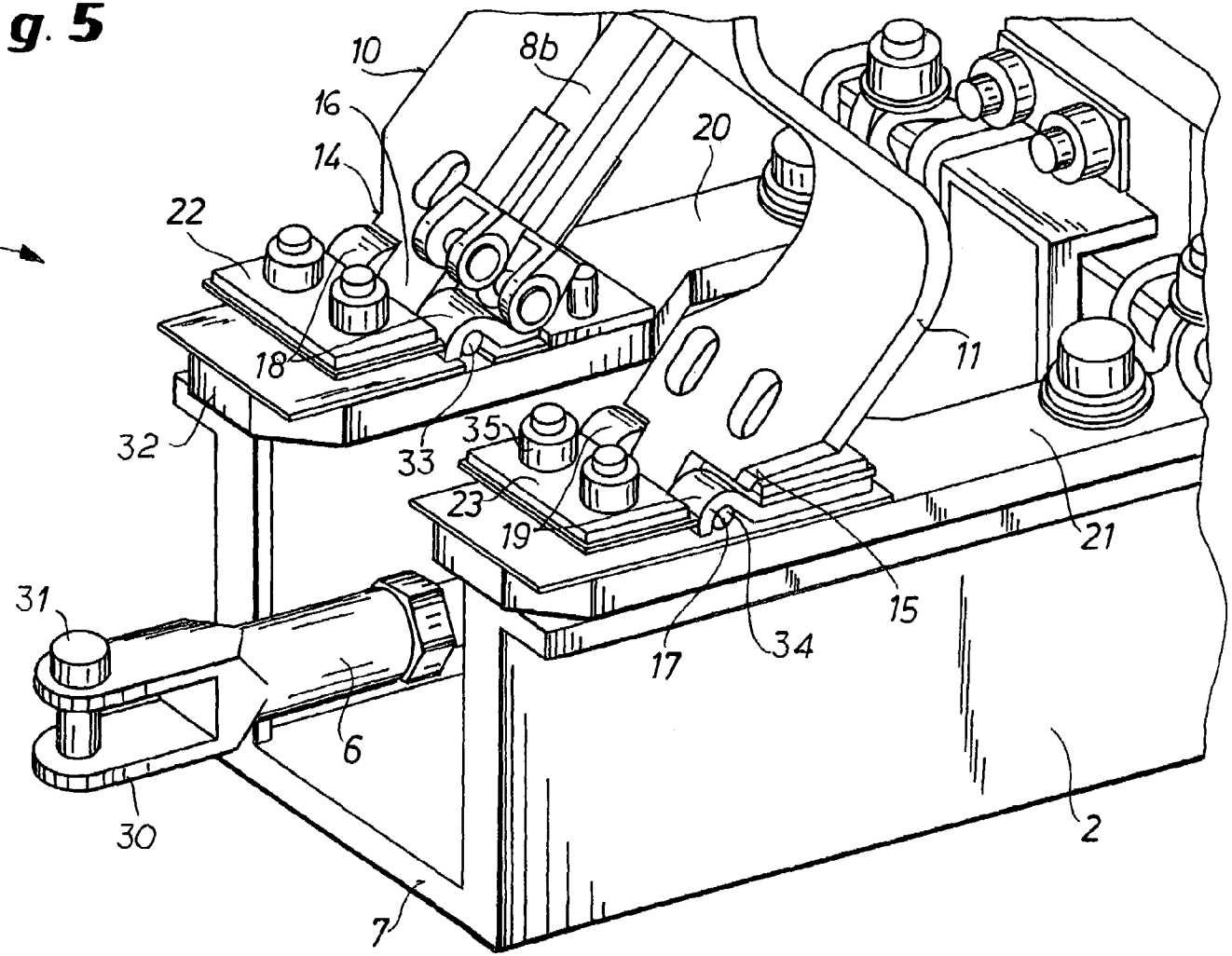
FIG. 5 is another large-scale view of a detail of the actuator.

Prior to use, the entire motor unit 8*a* is pivoted up about the axis 9 so that it lies wholly inward of the drive end 7 of the sleeper 2 as shown in FIGS. 3 and 4. A strut 29 extends between the end 26 of the bar 11 and a central point in the sleeper 2 to support the drive 8*a* that has a heavy motor.

Figure 2:
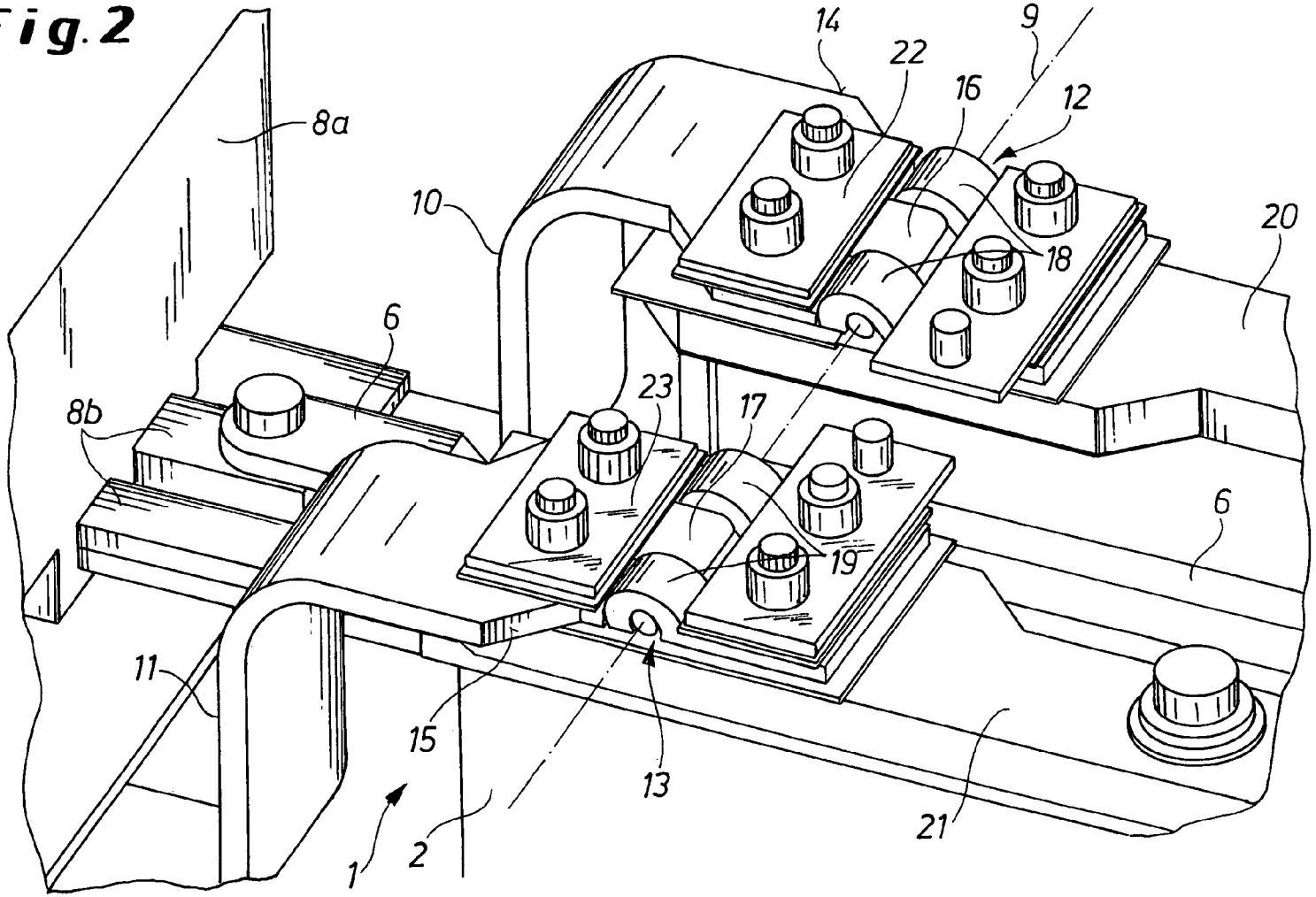
FIG. 2 is a large-scale view of a detail of FIG. 1.

Once the unit 1 is at the installation site, the strut 29 is removed and the motor 8*a* is swung out so as shown in FIG. 2 it is outside the end 7 and its output shaft 8*b* is coaxial with the rod 6. The shaft 8*b* can be coupled by a pin 31 to a fork 30 to the outer end of the rod 6. In this position plates 22 and 23 are secured by bolts 34 and 35 against the top faces of the inner ends 14 and 15 of the Z-shaped mounting bars 10 and 11 to lock the drive 8*a* in place.

Figure 6:
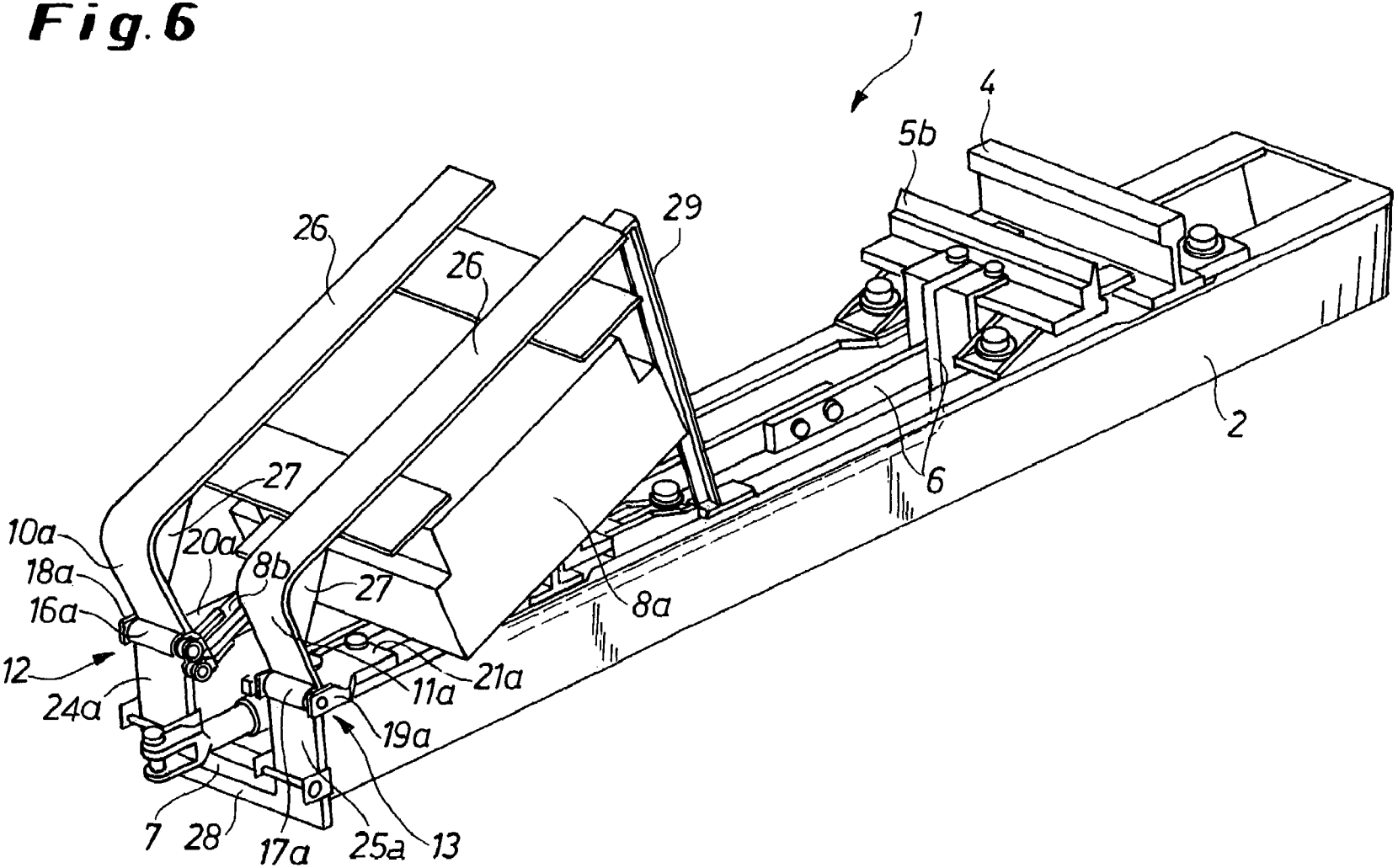
FIG. 6 is a view like FIG. 3 of another actuator according to the invention in the shipping position.
Figure 7:
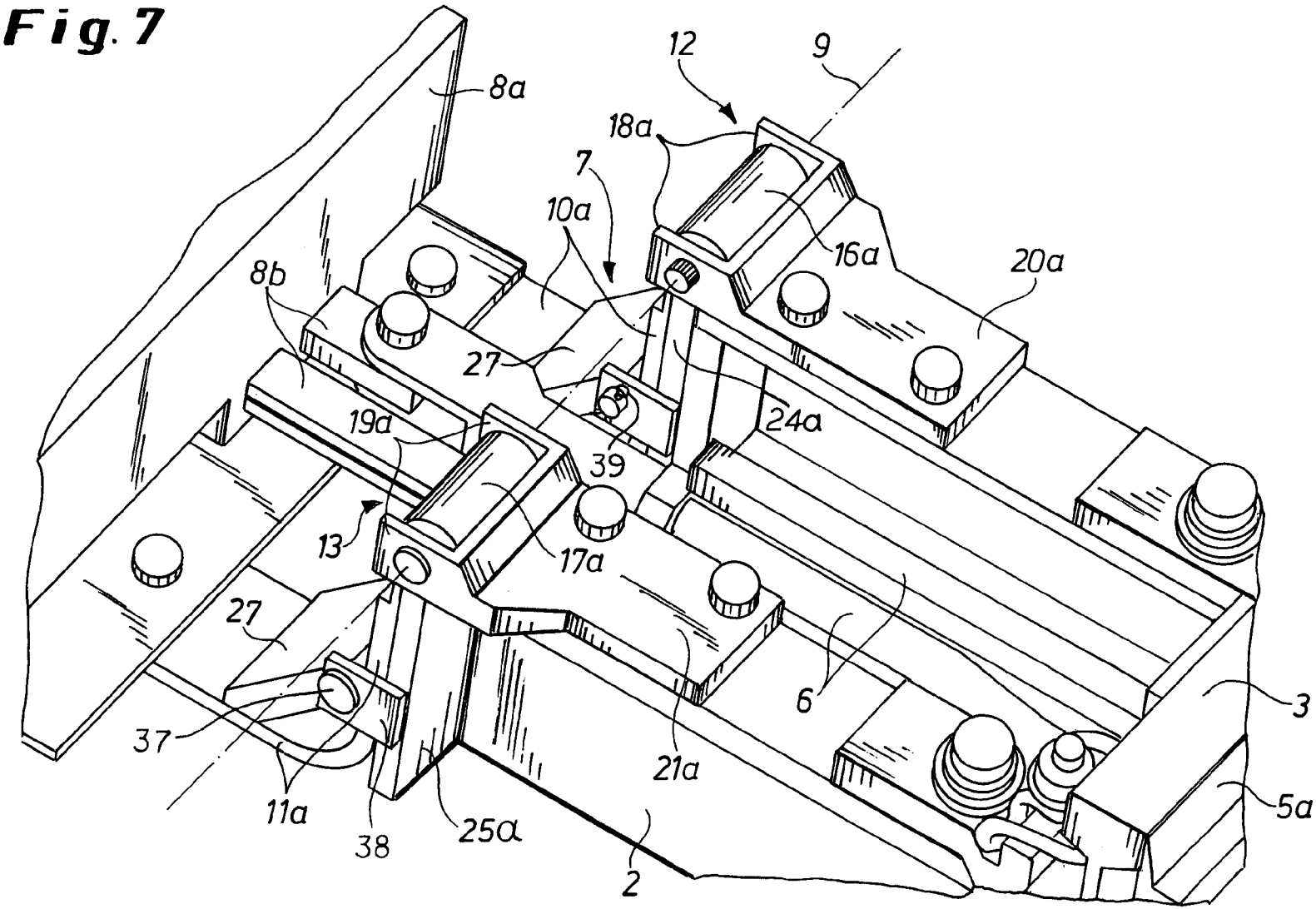
FIG. 7 is a large-scale perspective view of a detail of the actuator of FIG. 6 in the installed condition.

FIGS. 6 and 7 show another embodiment of the invention where the main difference is that the arms 10 and 11 are not used. Instead a pair of L-shaped plates 20*a* and 21*a* are bolted to the upper surfaces of the and that have outer ends projecting past the drive end 7 and formed as forks 18*a* and 19*a* in which fit eyes 16*a* and 17*a* of L-shaped arms 10*a* and 11*a*, with gussets 27 reinforcing inside corners of the L-shaped arms 10*a* and 11*a*. The plates 20*a* and 21*a* also have outer-end flanges 24*a* and 25*a* that extend downward and fit flatly against the drive end 7 and that are unitarily interconnected together below the rod 6 by a bar 28. When in the installed position, rods 37 passing through eyes 38 on the flanges 24*a* and 25*a* and secured in place by cotter pins 39 prevent the drive 8*a* from lifting up. Under normal circumstances, as in FIGS. 1 to 5, the connection of the drive shaft 8*b* to the rod 6 holds the drive 8*a* down, plus the orientation of the axis 36 below the axis 9.

We claim:

1. A railroad switch actuator comprising:

a transversely extending box sleeper having a pair of ends, adapted to be secured to a pair of longitudinally extending fixed rolling rails, and adapted to slidably support a pair of longitudinally extending and transversely shiftable switch tongues;

a switch rod extending transversely in the box sleeper, connected to the tongues, centered on a transverse axis, and displaceable along the transverse axis to shift the tongues;

a drive having an output shaft; and hinge means carrying the drive on the sleeper for pivotal movement at one of the sleeper ends between a down position outboard of the one sleeper end and with the output shaft axially aligned with the switch rod and an up position between the sleeper ends.

2. The railroad switch actuator defined in claim 1,further comprising a coupling engageable between the output shaft and the switch rod in the down position.

3. The railroad switch actuator defined in claim 1 wherein the hinge means defines a pivot axis that lies substantially above the switch-rod axis at the one sleeper end.

4. The railroad switch actuator defined in claim 1, further comprising means for locking the drive against the one sleeper end in the down position of the drive.

5. A railroad switch actuator comprising:

a transversely extending box sleeper having a pair of ends, adapted to be secured to a pair of longitudinally extending fixed rolling rails, and adapted to slidably support a pair of longitudinally extending and transversely shiftable switch tongues;

a switch rod extending transversely in the box sleeper, connected to the tongues, centered on a transverse axis, and displaceable along the transverse axis to shift the tongues;

a drive having an output shaft; and hinge means carrying the drive on the sleeper for pivotal movement at one of the sleeper ends between a down position outboard of the one sleeper end and with the output shaft axially aligned with the switch rod and an up position between the sleeper ends, the hinge means including two eyes centered on the pivot axis and fixed to an upper side of the box sleeper, and respective rigid arms on the drive having inner ends formed as eyes pivoted on the eyes of the sleeper.

6. The railroad switch actuator defined in claim 5 wherein the arms are generally Z-shaped and have outer ends extending underneath the drive.

7. The railroad switch actuator defined in claim 6 wherein the arms have webs that lie flatly against the one sleeper end in the down position of the drive.

8. The railroad switch actuator defined in claim 7, further comprising:

respective reinforcement webs on the arms at inside corners between the respective inner arms and webs.

9. The railroad switch actuator defined in claim 6 wherein the outer ends have tips that project in the down position horizontally outward past the drive, the actuator further comprising a sacrificial strut extending generally vertically between one of the outer-end tips and the box sleeper in the up position so as to support the drive on the box sleeper.

10. The railroad switch actuator defined in claim 6, further comprising respective L-shaped plates each having an inner leg forming a respective one of the eyes and lying on an upper surface of the box sleeper and an outer leg lying flatly against an end face of the one sleeper end.

11. The railroad switch actuator defined in claim 10, further comprising a web unitarily joining the outer legs of the plates below the rod axis.

* * * * *